US008698678B2

(12) United States Patent
Badaruzzaman et al.

(10) Patent No.: US 8,698,678 B2
(45) Date of Patent: Apr. 15, 2014

(54) MOBILE WIRELESS COMMUNICATIONS DEVICE WITH SLOTTED ANTENNA AND RELATED METHODS

(75) Inventors: Firass Mirza Badaruzzaman, Oak Park, IL (US); Shing Lung Steven Yang, Arlington Heights, IL (US); Sarah L. Kirchoff, Arlington Heights, IL (US)

(73) Assignee: BlackBerry Limited, Waterloo, Ontario (CA)

( * ) Notice: Subject to any disclaimer, the term of this patent is extended or adjusted under 35 U.S.C. 154(b) by 418 days.

(21) Appl. No.: 13/072,004

(22) Filed: Mar. 25, 2011

(65) Prior Publication Data

US 2012/0242548 A1 Sep. 27, 2012

Related U.S. Application Data

(60) Provisional application No. 61/466,802, filed on Mar. 23, 2011.

(51) Int. Cl.
*H01Q 13/16* (2006.01)

(52) U.S. Cl.
USPC ..... 343/702; 343/746; 343/749

(58) Field of Classification Search
USPC ..... 343/702, 746, 749
See application file for complete search history.

(56) References Cited

U.S. PATENT DOCUMENTS

| | | | | |
|---|---|---|---|---|
| 7,443,344 | B2 * | 10/2008 | Boyle | 343/700 MS |
| 2002/0140607 | A1 * | 10/2002 | Zhou | 343/700 MS |
| 2009/0153407 | A1 * | 6/2009 | Zhang et al. | 343/702 |
| 2009/0231213 | A1 | 9/2009 | Ishimiya | |
| 2010/0013732 | A1 * | 1/2010 | Kapuliansky et al. | 343/866 |
| 2011/0012790 | A1 | 1/2011 | Badaruzzaman et al. | 343/700 |
| 2012/0169547 | A1 * | 7/2012 | Oh et al. | 343/702 |

FOREIGN PATENT DOCUMENTS

| | | |
|---|---|---|
| JP | 2008167420 | 7/2008 |

* cited by examiner

*Primary Examiner* — Allyson Trail
(74) *Attorney, Agent, or Firm* — Allen, Dyer, Doppelt, Milbrath & Gilchrist, P.A.

(57) ABSTRACT

A mobile wireless communication device may include a multiple-band antenna on an antenna carrier and connected to a wireless transceiver. The multiple-band antenna may include an elongate base conductor having opposing first and second ends and opposing first and second sides extending between the first and second ends. The elongate base conductor may have a first L-shaped slot with a proximal end opening outwardly at the first side of the elongate base conductor adjacent the first end thereof and having a distal end adjacent a medial portion of the elongate base conductor. The elongate base conductor may have a second L-shaped slot with a proximal end opening outwardly at the first side of the elongate base conductor adjacent the medial portion thereof and having a distal end adjacent the second end of the elongate base conductor. The distal end of the second L-shaped slot may extend closer to the second end of the elongate base conductor than the distal end of the first L-shaped slot.

25 Claims, 8 Drawing Sheets

MOBILE WIRELESS COMMUNICATIONS DEVICE WITH SLOTTED ANTENNA AND RELATED METHODS

RELATED APPLICATION

This application is based upon prior filed provisional application Ser. No. 61/466,802 filed Mar. 23, 2011, the entire subject matter of which is incorporated herein by reference in its entirety.

TECHNICAL FIELD

This application relates to the field of communications, and more particularly, to antennas for wireless communications and related methods.

BACKGROUND

Cellular communication systems continue to grow in popularity and have become an integral part of both personal and business communications. Cellular telephones allow users to place and receive phone calls most anywhere they travel. Moreover, as cellular telephone technology is increased, so too has the functionality of cellular devices. For example, many cellular devices now incorporate Personal Digital Assistant (PDA) features such as calendars, address books, task lists, calculators, memo and writing programs, etc. These multi-function devices usually allow users to wirelessly send and receive electronic mail (email) messages and access the internet via a cellular network and/or a wireless local area network (WLAN), for example.

As the functionality of cellular communications devices continues to increase, so too does demand for smaller devices that are easier and more convenient for users to carry. Nevertheless, the move towards multi-functional devices makes miniaturization more difficult as the requisite number of installed components increases. Indeed, the typical cellular communications may include several antennas, for example, a cellular antenna, a global positioning antenna, and a WiFi IEEE 802.11g antenna. These antennas may comprise external antennas and internal antennas.

Generally speaking, internal antennas allow cell phones to have a smaller footprint than external antennas. Moreover, they are also are preferred over external antennas for mechanical and ergonomic reasons. Internal antennas are also protected by the mobile device housing and therefore tend to be more durable than external antennas. External antennas may be cumbersome and may make the mobile device difficult to use, particularly in limited-space environments. Yet, one potential drawback of typical internal cellular phone antennas is that they are in relatively close proximity to the user's head when the phone is in use. As an antenna moves closer to a user's body, the amount of radio frequency (RF) energy radiation absorbed by the body will typically increase. The amount of RF energy absorbed by a body when using a mobile phone is called the specific absorption rate (SAR), and the allowable SAR for mobile phones is typically limited by applicable government regulations to ensure safe user RF energy exposure levels.

DETAILED DESCRIPTION OF THE PREFERRED EMBODIMENTS

Figure 1:
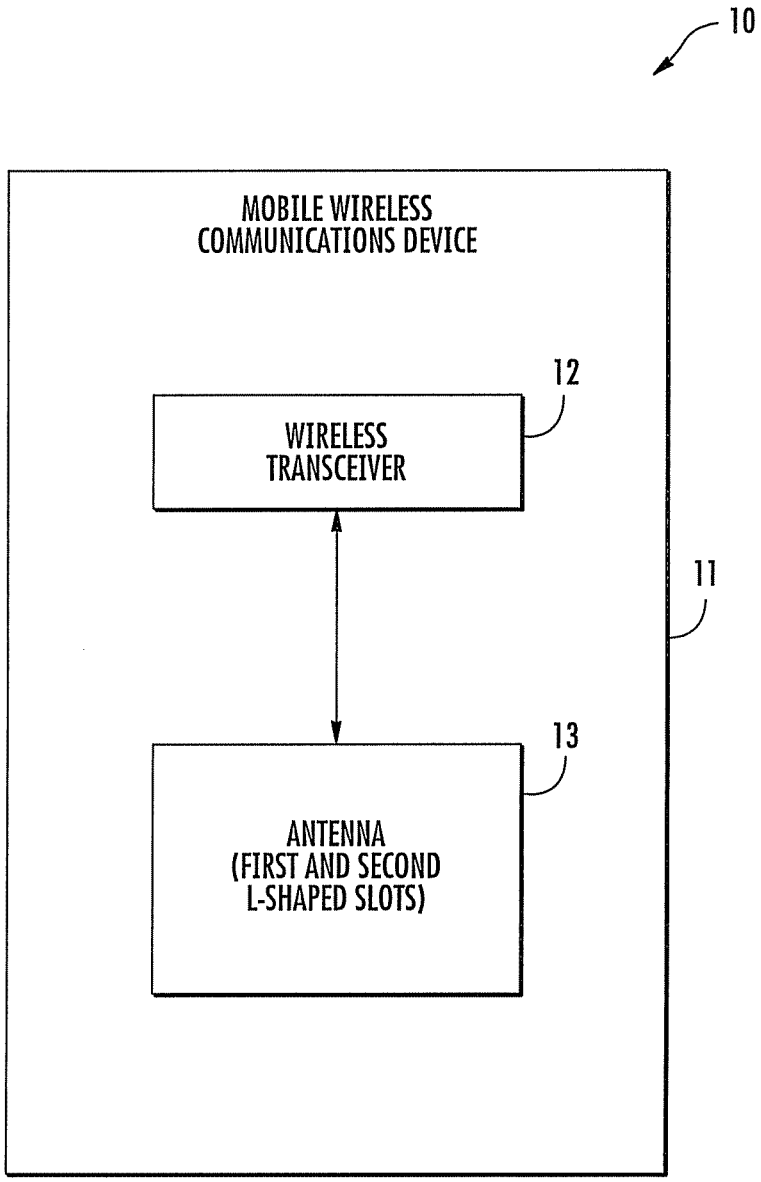
FIG. 1 is a schematic block diagram of an example embodiment of a mobile wireless communications device.

The present description is made with reference to the accompanying drawings, in which embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements or steps in alternative embodiments.

An example aspect is directed to a mobile wireless communication device that may comprise a housing, at least one wireless transceiver carried by the housing, an antenna carrier carried by the housing, and a multiple-band antenna on the antenna carrier and connected to the at least one wireless transceiver. The multiple-band antenna may include an elongate base conductor having opposing first and second ends and opposing first and second sides extending between the first and second ends. The elongate base conductor may have a first L-shaped slot with a proximal end opening outwardly at the first side of the elongate base conductor adjacent the first end thereof and having a distal end adjacent a medial portion of the elongate base conductor. The elongate base conductor may have a second L-shaped slot with a proximal end opening outwardly at the first side of the elongate base conductor adjacent the medial portion thereof and having a distal end adjacent the second end of the elongate base conductor. The distal end of the second L-shaped slot may extend closer to the second end of the elongate base conductor than the distal end of the first L-shaped slot.

More specifically, the multiple-band antenna may further comprise an elongate tuning arm conductor extending outwardly from the second side of the elongate base conductor adjacent the first end thereof. The elongate tuning arm conductor may be rectangle-shaped, for example. The elongate tuning arm conductor may extend perpendicularly from the second side of the elongate base conductor.

In some embodiments, the first and second L-shaped slots may be positioned in a nested arrangement. The first L-shaped slot may have an offset in a medial portion thereof. Additionally, the multiple-band antenna further may comprise a first feed point defined on the elongate base conductor between the first end thereof and the proximal end of the first L-shaped slot, and a second feed point defined on the elongate base conductor between the proximal ends of the first and second L-shaped slots.

In other embodiments, the elongate base conductor may have a microphone receiving opening therein along the first side and adjacent the second end thereof. The elongate base conductor may have a speaker receiving notch therein along the second side thereof adjacent the second end thereof.

Another example aspect is directed to a multiple-band antenna that may comprise an elongate base conductor having opposing first and second ends and opposing first and second sides extending between the first and second ends. The elongate base conductor may have a first L-shaped slot with a proximal end opening outwardly at the first side of the elongate base conductor adjacent the first end thereof and having a distal end adjacent a medial portion of the elongate base conductor. The elongate base conductor may have a second L-shaped slot with a proximal end opening outwardly at the first side of the elongate base conductor adjacent the medial portion thereof and having a distal end adjacent the second end of the elongate base conductor. The distal end of the second L-shaped slot may extend closer to the second end of the elongate base conductor than the distal end of the first L-shaped slot.

Yet another example aspect is directed to a method for making a multiple-band antenna. The method may include forming an elongate base conductor having opposing first and second ends and opposing first and second sides extending between the first and second ends, and forming the elongate base conductor to have a first L-shaped slot with a proximal end opening outwardly at the first side of the elongate base conductor adjacent the first end thereof and having a distal end adjacent a medial portion of the elongate base conductor. The method may include forming the elongate base conductor to have a second L-shaped slot with a proximal end opening outwardly at the first side of the elongate base conductor adjacent the medial portion thereof and having a distal end adjacent the second end of the elongate base conductor. The distal end of the second L-shaped slot may extend closer to the second end of the elongate base conductor than the distal end of the first L-shaped slot.

Example mobile wireless communications devices may include portable or personal media players (e.g., music or MP3 players, video players, etc.), remote controls (e.g., television or stereo remotes, etc.), portable gaming devices, portable or mobile telephones, smartphones, tablet computers, etc.

Figure 2:
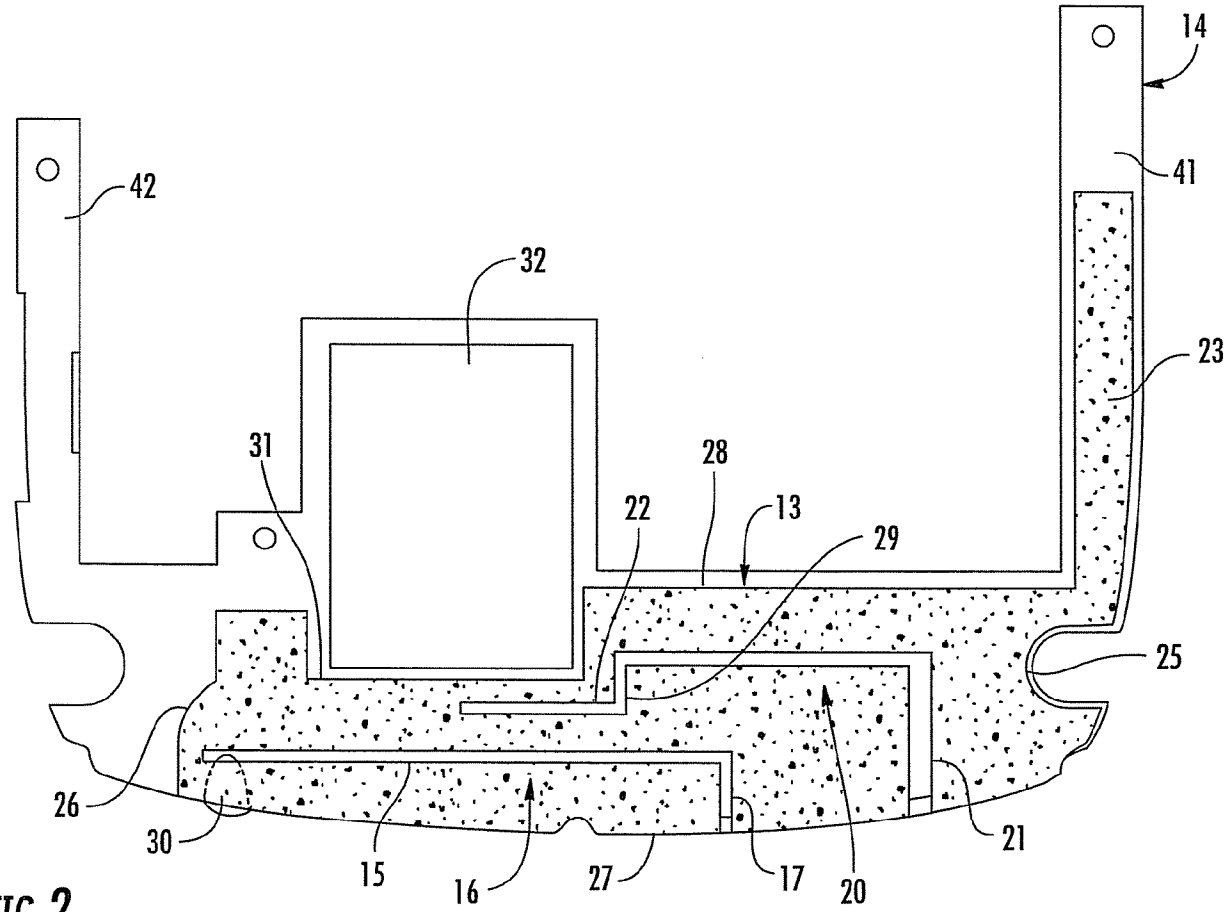
FIG. 2 is a top plan view of the antenna and antenna carrier from the mobile wireless communications device of FIG. 1.
Figure 3:
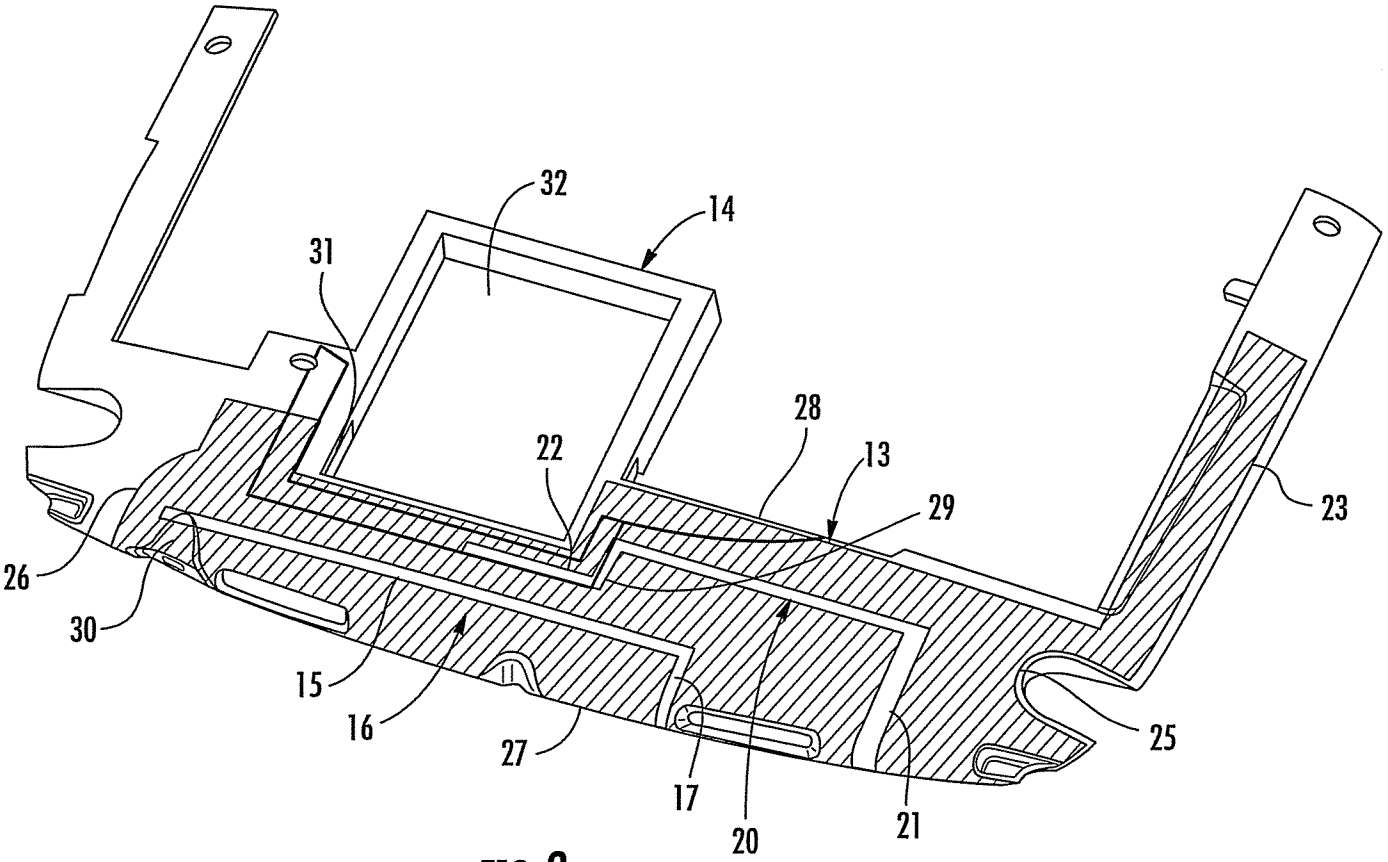
FIG. 3 is a perspective view of the antenna and antenna carrier from the mobile wireless communications device of FIG. 1.

Referring now to FIGS. 1-3, a mobile wireless communications device 10 according to the present disclosure is now described. The mobile wireless communication device 10 illustratively includes a housing 11, a wireless transceiver 12 carried by the housing, an antenna carrier 14 carried by the housing, and a multiple-band antenna 13 on the antenna carrier and connected to the wireless transceiver. For example, the wireless transceiver 12 may comprise a cellular transceiver. The multiple-band antenna 13 is illustratively positioned in a lower portion of the housing 11, thereby providing a reduced SAR value.

As will be appreciated by those skilled in the art, the multiple-band antenna 13 is positioned on the antenna carrier 14 for performance reasons. In particular, the composition of the antenna carrier 14 may be modified to provide a desirable dielectric loss constant. For example, the antenna carrier 14 may comprise plastic. Moreover, the multiple-band antenna 13 may comprise an electrically conductive material, such a metal, and may be formed on the antenna carrier 14 using laser directed structuring (LDS), etching, or machining, for example.

Figure 4:
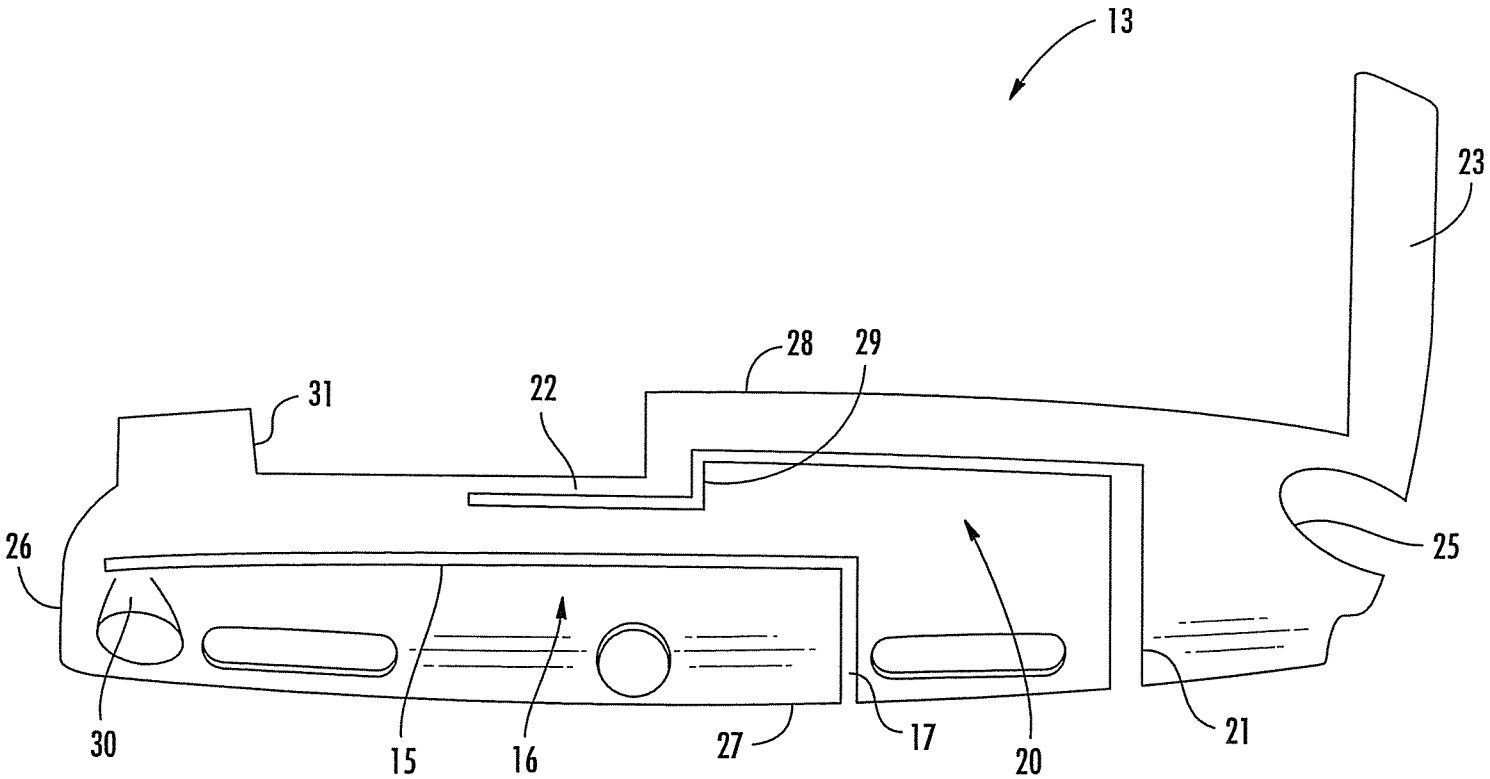
FIG. 4 is a top plan view of the antenna from the mobile wireless communications device of FIG. 1.
Figure 5:
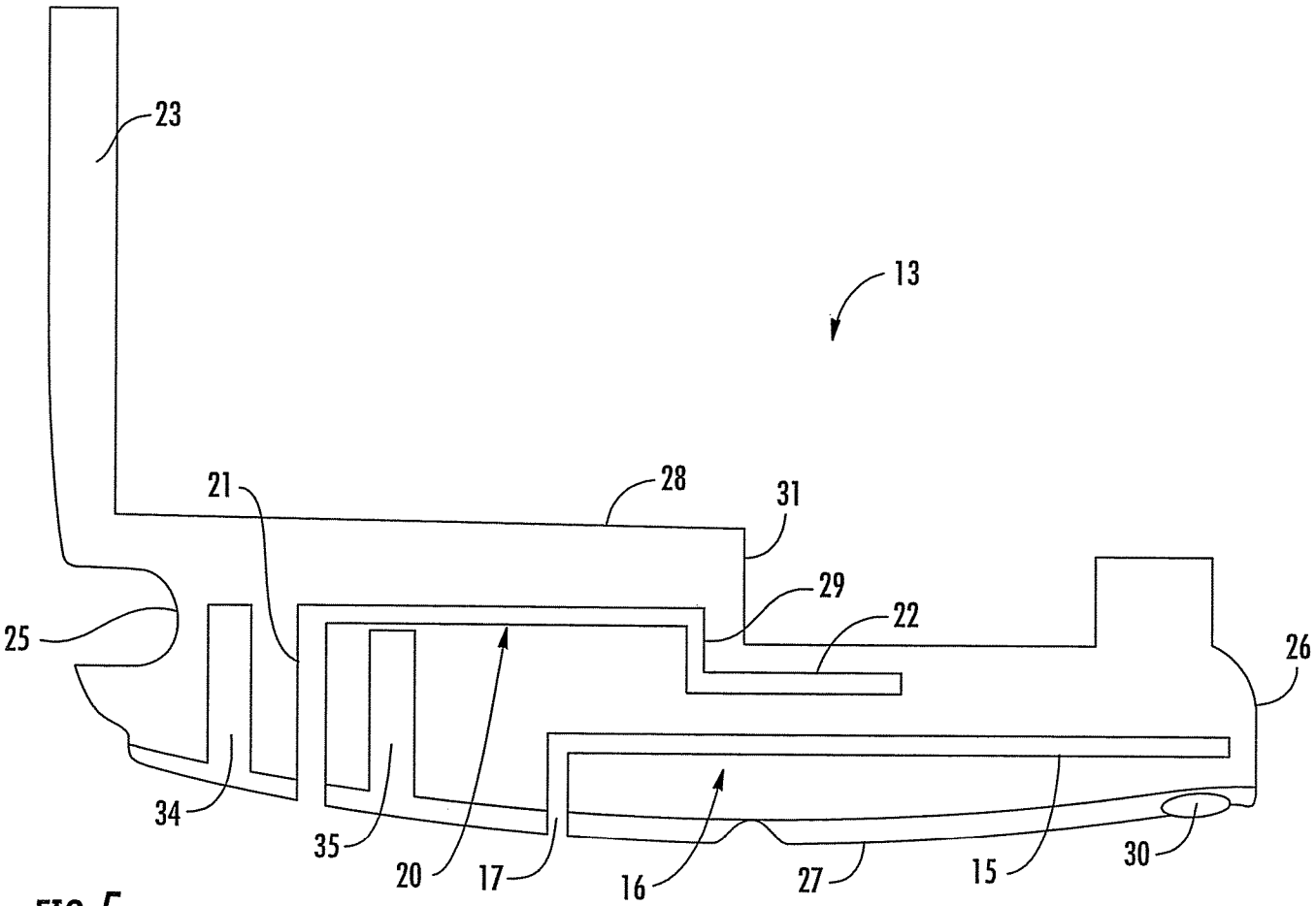
FIG. 5 is a bottom plan view of the antenna from the mobile wireless communications device of FIG. 1.

Referring additionally to FIGS. 4-5, the multiple-band antenna 13 illustratively includes an elongate base conductor having opposing first and second ends 25-26 and opposing first and second sides 27-28 extending between the first and second ends. The elongate base conductor illustratively includes a first L-shaped slot 20 with a proximal end 21 opening outwardly at the first side 27 of the elongate base conductor adjacent the first end 25 thereof. The first L-shaped slot 20 illustratively includes a distal end 22 adjacent a medial portion of the elongate base conductor. The first L-shaped slot 20 illustratively has an offset 29 in a medial portion thereof. In other words, the proximal and distal ends 21-22 of the first L-shaped slot 20 are each L-shaped and arranged to be stacked adjacent each other, but with the distal L-shaped end being flipped with respect to the proximal L-shaped end.

The elongate base conductor illustratively includes a second L-shaped slot 16 with a proximal end 17 opening outwardly at the first side 27 of the elongate base conductor adjacent the medial portion thereof. The second L-shaped slot 16 illustratively includes a distal end 15 adjacent the second end 26 of the elongate base conductor. The distal end 15 of the second L-shaped slot 16 illustratively extends closer to the second end 26 of the elongate base conductor than the distal end 22 of the first L-shaped slot 20. In the illustrated embodiment, the first and second L-shaped slots 20, 16 are positioned in a nested arrangement.

In the illustrated embodiment, each of first and second L-shaped slots 20, 16 has sides substantially parallel to each other, but in other embodiments, the sides may be canted or positioned at an angle to each other. Moreover, each of first and second L-shaped slots 20, 16 are substantially rectangle-shaped, but in other embodiments, they may have a varying shape, such as being triangle-shaped or circle-shaped.

As will be appreciated by those skilled in the art, each of first and second L-shaped slots 20, 16 is tuned for operation in a desired frequency band. For example, the first L-shaped slot 20 may be tuned at the 1800 MHz and 1900 MHz bands, and the second L-shaped slot 16 may be tuned at the 1900 MHz and 2100 MHz bands.

Additionally, the multiple-band antenna 13 illustratively includes an elongate tuning arm conductor 23 extending outwardly from the second side 28 of the elongate base conductor adjacent the first end 25 thereof. Advantageously, the elongate tuning arm conductor 23 may merge the slot resonances of the first and second L-shaped slots 20, 16. On the other hand, the tuning of the low band operation of the multiple-band antenna 13 is accomplished via the body of the elongate base conductor. In the illustrative embodiment, the elongate tuning arm conductor 23 is substantially rectangle-shaped, for example. Of course in other embodiments, the elongate tuning arm conductor 23 may have a varying shape, such as being triangle-shaped or circle-shaped. Also, the elongate tuning arm conductor 23 illustratively extends substantially perpendicularly from the second side 28 of the elongate base conductor.

Furthermore, the elongate base conductor illustratively includes a microphone receiving opening 30 therein along the first side 27 and adjacent the second end 26 thereof. Of course, in other embodiments, the microphone receiving opening 30 may be moved to other positions on the first side 27, or entirely omitted. The elongate base conductor illustratively includes a speaker receiving notch 31 therein along the second side 28 thereof adjacent the second end 26 thereof. Of course, in other embodiments, the speaker receiving notch 31 may be omitted or have a different shape, such as being curved or triangle-shaped.

As perhaps best seen in FIG. 5, the multiple-band antenna 13 illustratively includes a first feed point 34 defined on the elongate base conductor between the first end 25 thereof and the proximal end 21 of the first L-shaped slot 20, and a second feed point 35 defined on the elongate base conductor between the proximal ends 21, 17 of the first and second L-shaped slots 20, 16. For example, in the illustrated embodiment, the first feed point 34 may comprise a ground point, i.e. it is coupled to a ground plane in the circuit board of the mobile wireless communications device 10, and the second feed point 35 may comprise an antenna feed point. Moreover, each of first and second feed points 34-35 are substantially rectangle-shaped, but in other embodiments, they may have a varying shape, such as being triangle-shaped or circle-shaped.

In particular, in the illustrated embodiment, the first end 25 illustratively includes a curved notch, and the antenna carrier 14 also includes a corresponding notch for permitting retaining screws (not shown) to affix the housing 11 to the underlying circuit board (not shown). Of course, in other embodiments, the notch may be omitted or have a different shape, such as triangle or square shaped. The first side 27 is illustratively convex in shape, but could be otherwise substantially straight in other embodiments. The second end 26 illustratively includes a curved first portion adjacent the first side 27, and a second portion adjacent the second side 28 that is substantially straight. The second side 28 illustratively includes a first portion adjacent the second end 26 that is substantially rectangular in shape and having the speaker receiving notch 31 therein. As perhaps best seen in FIG. 3, the antenna carrier 14 illustratively includes a frame 32 corresponding to the speaker receiving notch 31. The second side 28 illustratively includes a second portion adjacent the first end 25 that is substantially straight and couples with the elongate tuning arm conductor 23.

Moreover, the antenna carrier 14 illustratively includes a pair of arms 41-42 extending substantially perpendicular from a base thereof. The elongate tuning arm conductor 23 is positioned on a first arm 41 of the antenna carrier 14. In other embodiments, the second arm 42 may provide a base for other modular antenna systems, for example, a Bluetooth™ communications antenna.

As will be appreciated by those skilled in the art, the shape of the multiple-band antenna 13 disclosed herein is in part based upon the spacing constraints in the housing 11 of the mobile wireless communications device 10. In other words, depending on the application, the shape and dimensions of the outer perimeter of the multiple-band antenna 13 may be altered to provide a proper fit.

Figure 6:
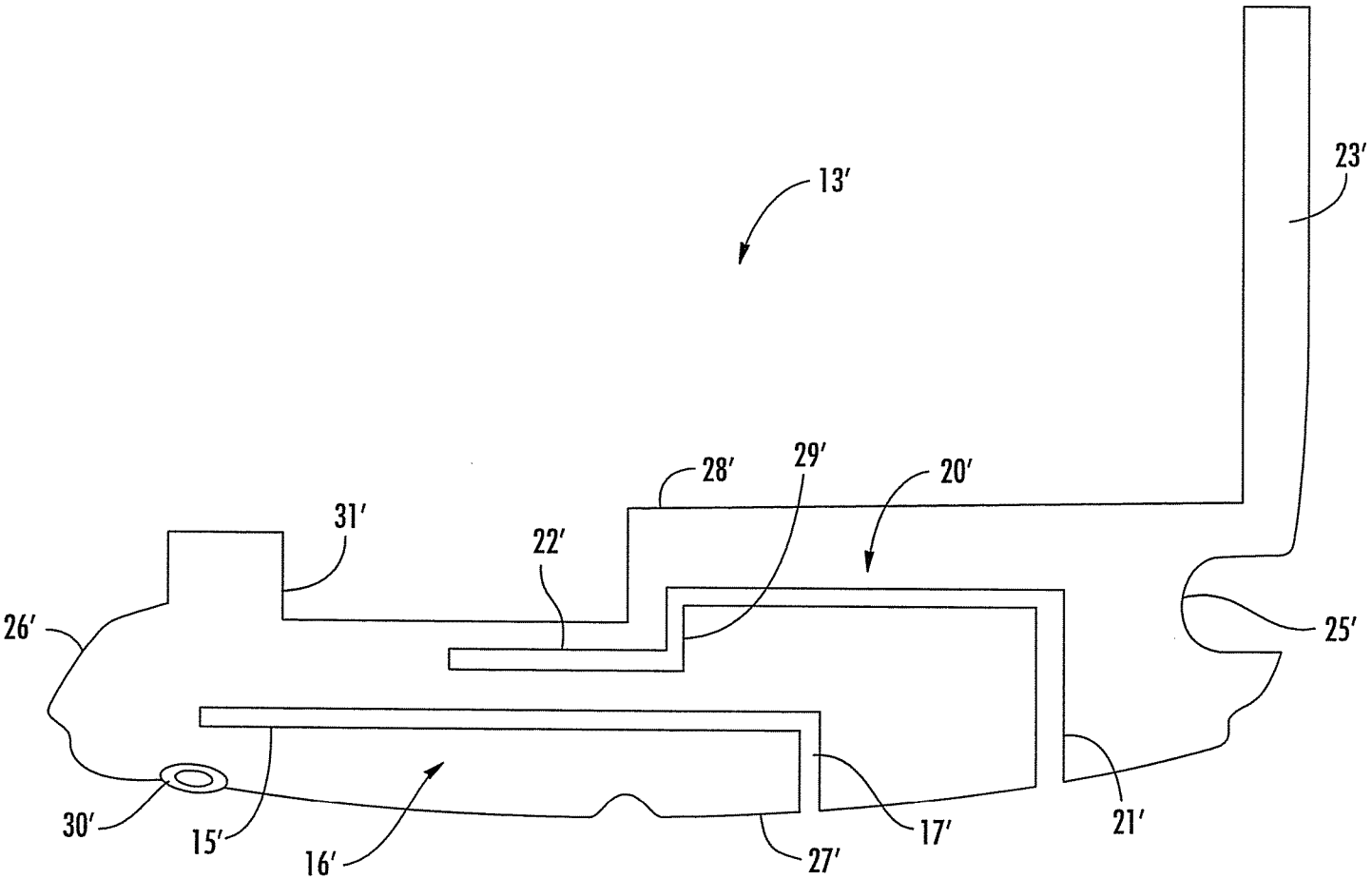
FIG. 6 is a top plan view of another example embodiment of the antenna from the mobile wireless communications device of FIG. 1.
Figure 7:
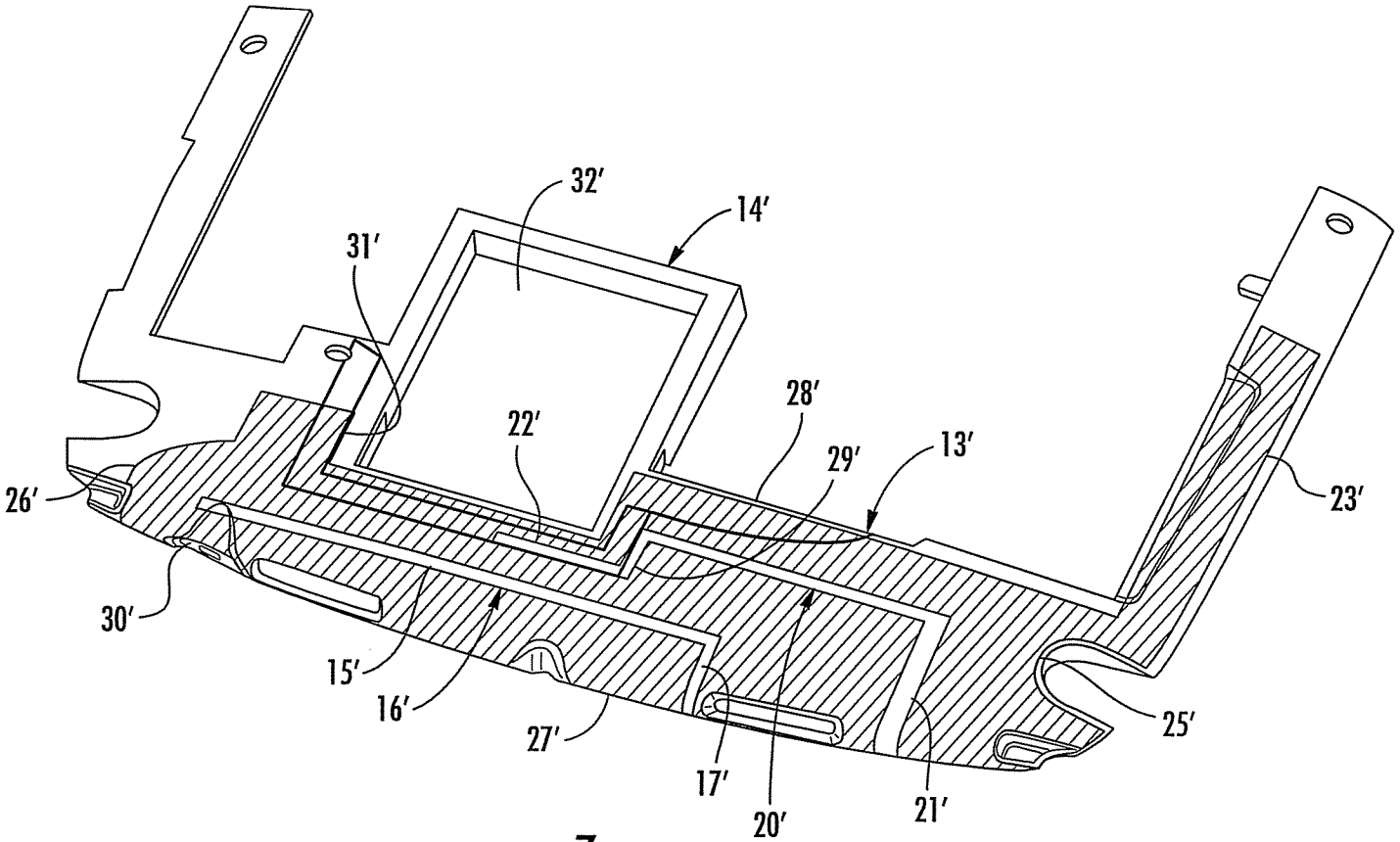
FIG. 7 is a perspective view of another example embodiment of the antenna and antenna carrier from the mobile wireless communications device of FIG. 1.

Referring now to FIGS. 6-7, another embodiment of the multiple-band antenna 13 is now described. In this embodiment of the multiple-band antenna 13', those elements already discussed above with respect to FIGS. 1-5 are given prime notation and most require no further discussion herein. This embodiment differs from the previous embodiment in that the multiple-band antenna 13' includes shorter distal portions 22', 15' for the first and second L-shaped slots 20', 16'. Moreover, the second end 26' of the elongate base structure has a differing shape, and in particular, protrudes out laterally to a greater degree. In particular, the second end 26' illustratively includes a first portion adjacent the first side 27' that is curved and undulates, and a second portion adjacent the second side 28' that illustratively includes an oblique angled bend.

Example components of a mobile wireless communications device 1000 that may be used in accordance with the above-described embodiments are further described below with reference to FIG. 8. The device 1000 illustratively includes a housing 1200, a keyboard or keypad 1400 and an output device 1600. The output device shown is a display 1600, which may comprise a full graphic liquid crystal display (LCD). Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400.

The housing 1200 may be elongated vertically, or may take on other sizes and shapes (including clamshell housing structures). The keypad may include a mode selection key, or other hardware or software for switching between text entry and telephony entry.

Figure 8:
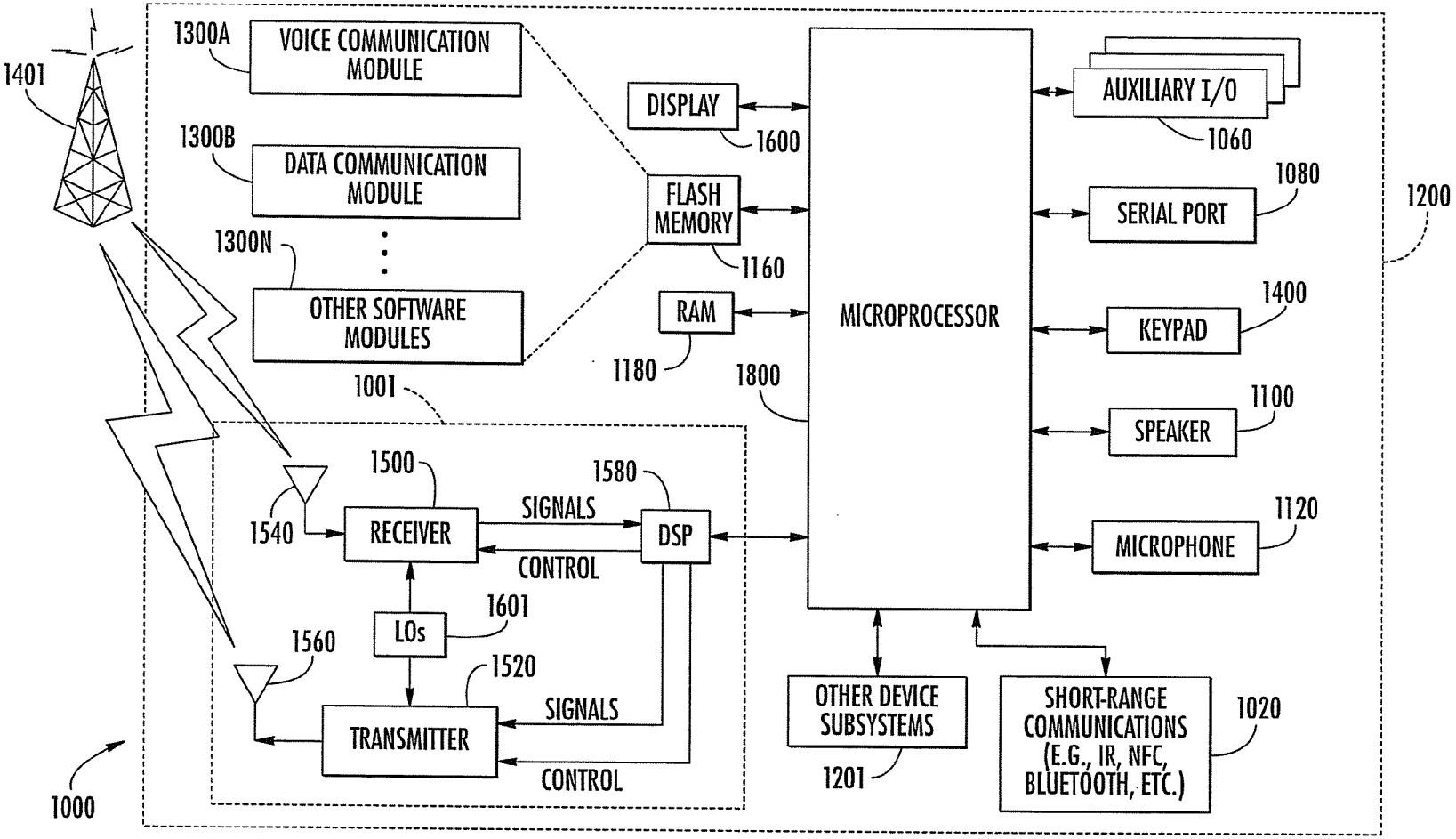
FIG. 8 is a schematic block diagram illustrating example components that may be used with the mobile wireless communications device of FIG. 1.

In addition to the processing device 1800, other parts of the mobile device 1000 are shown schematically in FIG. 8. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having data and, optionally, voice communications capabilities. In addition, the mobile device 1000 may have the capability to communicate with other computer systems via the Internet.

Operating system software executed by the processing device 1800 is stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300E, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with corresponding data items stored or associated with a host computer system.

Communication functions, including data and voice communications, are performed through the communications subsystem 1001, and possibly through the short-range communications subsystem 1020. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as Advanced Mobile Phone System (AMPS), time division multiple access (TDMA), code division multiple access (CDMA), Wideband code division multiple access (W-CDMA), personal communications service (PCS), GSM (Global System for Mobile Communications), enhanced data rates for GSM evolution (EDGE), etc. Other types of data and voice networks, both separate and integrated, may also be utilized with the mobile device 1000. The mobile device 1000 may also be compliant with other communications standards such as 3GSM, 3rd Generation Partnership Project (3GPP), Universal Mobile Telecommunications System (UMTS), 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore typically involves use of a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device may also be used to compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, a Bluetooth™ communications module to provide for communication with similarly-enabled systems and devices, or a NFC sensor for communicating with a NFC device or NFC tag via NFC communications.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communication device comprising:
a housing;
at least one wireless transceiver carried by said housing;
an antenna carrier carried by said housing; and
a multiple-band antenna on said antenna carrier and connected to said at least one wireless transceiver, said multiple-band antenna comprising
an elongate base conductor having opposing first and second ends and opposing first and second sides extending between the first and second ends,
said elongate base conductor having a first L-shaped slot with a proximal end opening outwardly at the first side of said elongate base conductor adjacent the first end thereof and having a distal end adjacent a medial portion of said elongate base conductor,
said elongate base conductor having a second L-shaped slot with a proximal end opening outwardly at the first side of said elongate base conductor adjacent the medial portion thereof and having a distal end adjacent the second end of said elongate base conductor,
the distal end of said second L-shaped slot extending closer to the second end of said elongate base conductor than the distal end of said first L-shaped slot.

2. The mobile wireless communication device of claim 1 wherein said multiple-band antenna further comprises an elongate tuning arm conductor extending outwardly from the second side of said elongate base conductor adjacent the first end thereof.

3. The mobile wireless communication device of claim 2 wherein said elongate tuning arm conductor is rectangle-shaped.

4. The mobile wireless communication device of claim 2 wherein said elongate tuning arm conductor extends perpendicularly from the second side of said elongate base conductor.

5. The mobile wireless communication device of claim 1 wherein said first and second L-shaped slots are positioned in a nested arrangement.

6. The mobile wireless communication device of claim 1 wherein said first L-shaped slot has an offset in a medial portion thereof.

7. The mobile wireless communication device of claim 1 wherein said multiple-band antenna further comprises:
a first feed point defined on said elongate base conductor between the first end thereof and the proximal end of the first L-shaped slot; and
a second feed point defined on said elongate base conductor between the proximal ends of the first and second L-shaped slots.

8. The mobile wireless communication device of claim 1 wherein said elongate base conductor has a microphone receiving opening therein along the first side and adjacent the second end thereof.

9. The mobile wireless communication device of claim 1 wherein said elongate base conductor has a speaker receiving notch therein along the second side thereof adjacent the second end thereof.

10. A multiple-band antenna comprising:

an elongate base conductor having opposing first and second ends and opposing first and second sides extending between the first and second ends;

said elongate base conductor having a first L-shaped slot with a proximal end opening outwardly at the first side of said elongate base conductor adjacent the first end thereof and having a distal end adjacent a medial portion of said elongate base conductor;

said elongate base conductor having a second L-shaped slot with a proximal end opening outwardly at the first side of said elongate base conductor adjacent the medial portion thereof and having a distal end adjacent the second end of said elongate base conductor;

the distal end of said second L-shaped slot extending closer to the second end of said elongate base conductor than the distal end of said first L-shaped slot.

11. The multiple-band antenna of claim 10 further comprising an elongate tuning arm conductor extending outwardly from the second side of said elongate base conductor adjacent the first end thereof.

12. The multiple-band antenna of claim 11 wherein said elongate tuning arm conductor is rectangle-shaped.

13. The multiple-band antenna of claim 11 wherein said elongate tuning arm conductor extends perpendicularly from the second side of said elongate base conductor.

14. The multiple-band antenna of claim 10 wherein said first and second L-shaped slots are positioned in a nested arrangement.

15. The multiple-band antenna of claim 10 wherein said first L-shaped slot has an offset in a medial portion thereof.

16. The multiple-band antenna of claim 10 further comprising:

a first feed point defined on said elongate base conductor between the first end thereof and the proximal end of the first L-shaped slot; and a second feed point defined on said elongate base conductor between the proximal ends of the first and second L-shaped slots.

17. The multiple-band antenna of claim 10 wherein said elongate base conductor has a microphone receiving opening therein along the first side and adjacent the second end thereof.

18. The multiple-band antenna of claim 10 wherein said elongate base conductor has a speaker receiving notch therein along the second side thereof adjacent the second end thereof.

19. A method for making a multiple-band antenna comprising:

forming an elongate base conductor having opposing first and second ends and opposing first and second sides extending between the first and second ends;

forming the elongate base conductor to have a first L-shaped slot with a proximal end opening outwardly at the first side of the elongate base conductor adjacent the first end thereof and having a distal end adjacent a medial portion of the elongate base conductor; and forming the elongate base conductor to have a second L-shaped slot with a proximal end opening outwardly at the first side of the elongate base conductor adjacent the medial portion thereof and having a distal end adjacent the second end of the elongate base conductor, the distal end of the second L-shaped slot extending closer to the second end of the elongate base conductor than the distal end of the first L-shaped slot.

20. The method of claim 19 further comprising forming an elongate tuning arm conductor extending outwardly from the second side of the elongate base conductor adjacent the first end thereof.

21. The method of claim 20 wherein the elongate tuning arm conductor is rectangle-shaped.

22. The method of claim 20 wherein the elongate tuning arm conductor extends perpendicularly from the second side of the elongate base conductor.

23. The method of claim 19 further comprising:

forming a first feed point defined on the elongate base conductor between the first end thereof and the proximal end of the first L-shaped slot; and forming a second feed point defined on the elongate base conductor between the proximal ends of the first and second L-shaped slots.

24. The method of claim 19 further comprising forming the elongate base conductor to include a microphone receiving opening therein along the first side and adjacent the second end thereof.

25. The method of claim 19 further comprising forming the elongate base conductor to include a speaker receiving notch therein along the second side thereof adjacent the second end thereof.

* * * * *